US006321584B1

(12) United States Patent
Chen et al.

(10) Patent No.: US 6,321,584 B1
(45) Date of Patent: Nov. 27, 2001

(54) METHOD AND MACHINE FOR MAKING FOLDED FINS FOR A HEAT SINK

(75) Inventors: Yu Pin Chen, Kaohsiung; Kuo Chuang Lin; Chao Kun Tseng, both of Taipei, all of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/430,344

(22) Filed: Oct. 29, 1999

(51) Int. Cl.[7] ..... B21D 53/04

(52) U.S. Cl. ..... 72/295; 72/383; 29/727; 29/890.03

(58) Field of Search ..... 72/295, 301, 384, 72/385, 379.6, 379.2, 383; 29/727, 890.03

(56) References Cited

U.S. PATENT DOCUMENTS

| | | | | |
|---|---|---|---|---|
| 3,164,891 | * | 1/1965 | Gier | 72/383 |
| 3,385,092 | * | 5/1968 | Scott | 72/385 |
| 3,722,254 | * | 3/1973 | Katogir | 72/383 |
| 3,842,648 | * | 10/1974 | Schwartz | 72/383 |
| 4,351,178 | * | 9/1982 | Uehara | 72/383 |
| 6,195,874 | * | 3/2001 | Chen | 29/890.03 |

FOREIGN PATENT DOCUMENTS

| | | | | |
|---|---|---|---|---|
| 3018120 | * | 5/1982 | (DE) | 72/384 |
| 149022 | * | 6/1988 | (JP) | 72/383 |

* cited by examiner

*Primary Examiner*—Daniel C. Crane
(74) *Attorney, Agent, or Firm*—Wei Te Chung

(57) ABSTRACT

A method for making a folded fin for a heat sink comprises the steps of: preparing a metal plate; clamping the metal plate with three forming jigs in an initial position, the lower jig portion of the second forming jig having a tapered end; actuating the second forming jig to upwardly move toward the first forming jig at a specified angle and the third forming jig to horizontally move toward the first forming jig to a second position where a portion of the metal plate between the forming jigs has been bent into a pair of symmetrically inclined sections; and actuating the lower jig portion of the second forming jig to downwardly move away from the metal plate at a specified angle, and the third forming jig and the upper jig portion of the second forming jig to continue moving toward the first forming jig to a final position where the pair of symmetrically inclined sections of the metal plate has been bent double thereby forming a folded fin. A machine is disclosed to make the folded fin by the method disclosed above.

16 Claims, 12 Drawing Sheets

METHOD AND MACHINE FOR MAKING FOLDED FINS FOR A HEAT SINK

BACKGROUND OF THE INVENTION

1. Field of the Invention

The present invention relates to a method for making a fin for a heat sink, and particularly to a method for making a folded fin for a heat sink having a pair of vertical sections bent double. A machine is also disclosed for use with the method described.

2. Description of Prior Art

As heat generating components in a computer, such as CPUs and chips, contain more circuitry and operate at faster speeds, greater amounts of heat are generated, which must be dissipated for reliable operation. A heat sink made from a heat conductive material, such as aluminum, is commonly used to dissipate the heat generated by a heat generating component. The heat sink is retained in direct contact with the heat generating component to dissipate the heat into the surrounding environment.

A conventional heat sink 10 is shown in FIG. 12. The heat sink 10 comprises a plurality of fins 12 integrally formed by extruding. The manufacturing cost using this method is relatively high.

FIG. 13 shows another conventional heat sink 11 consisting of a base plate 13 and a heat dissipating member 14 attached together. The heat dissipating member 14 is formed by stamping a metal plate or by extruding from aluminum materials and comprises a plurality of U-shaped fins 142 interconnected by planar portions 144. The heat dissipating member 14 is attached to the base plate 13 by heat conductive epoxy adhesive or by rivets.

A problem with such an arrangement is that an additional fan must be used to enhance the heat dissipating effectiveness of the heat sink 11. The heat generated by a heat generating component 1 in phantom is transmitted to the base plate 13 and radiates from the base plate 13 via three paths as indicated by arrows A, B and C. The heat transmitted via the paths A and C easily dissipates into the surrounding environment. However, the heat transmitted via the path B tends to accumulate in a space 143 defined in the U-shaped fin 142 and does not dissipate as readily thereby degrading the heat dissipating effectiveness of the heat sink 11. Therefore, an additional fan (not shown) must be used to forcibly expel the heat from the space 143 in cooperation with the heat sink 11. However, the fan occupies space, consumes electric power and increases the cost. The noise made by the fan is a further disadvantage. Furthermore, the fan has a fixed life span and vibrates during operation thereby adversely affecting connections with other components.

Therefore, a heat sink, which has an enhanced heat dissipating capability without requiring use of a fan, is desirable. The present invention meets such a requirement by providing a heat sink having a plurality of folded fins.

SUMMARY OF THE INVENTION

Accordingly, one object of the present invention is to provide a method for making folded fins for a heat sink which prevents heat accumulation.

Another object of the present invention is to provide a machine for making a heat dissipating member for a heat sink by bending a metal plate, the heat dissipating member having a plurality of folded fins.

A further object of the present invention is to provide a heat dissipating member for a heat sink having a plurality of folded fins interconnected by planar portions, each folded fin comprising a first and a second vertical sections made from a single metal sheet bent double.

In order to achieve the objects set forth, a method for making a folded fin of a heat sink, comprises the steps of:

a) preparing a metal plate;

b) clamping the metal plate with a first, a second and a third forming jigs in an initial position, the second forming jig being located between the first and the third forming jigs, each forming jig including upper and lower jig portions, the lower jig portion of the second forming jig having a tapered end;

c) actuating the second forming jig to upwardly move toward the first forming jig at a specified angle and the third forming jig to horizontally move toward the first forming jig to a second position where a portion of the metal plate between the first and the third forming jigs has been bent into a pair of symmetrically inclined sections; and d) actuating the lower jig portion of the second forming jig to downwardly move away from the metal plate at a specified angle, and the third forming jig and the upper jig portion of the second forming jig to continue moving toward the first forming jig to a final position where the pair of symmetrically inclined sections of the metal plate between the forming jigs has been bent double thereby forming a folded fin.

A machine for performing the aforesaid method is also provided by the present invention. The machine comprise a fixed machine tool, a fixed jig actuatably mounted on the fixed machine tool, a carriage for horizontally reciprocating along the machine tool, and a first, a second and a third forming jigs sequentially and actuatably mounted on the carriage each including upper and lower jig portions. The lower jig portion of the second forming jig has a tapered end.

Other objects, advantages and novel features of the invention will become more apparent from the following detailed description when taken in conjunction with the accompanying drawings.

DETAILED DESCRIPTION OF THE INVENTION

Figure 1:
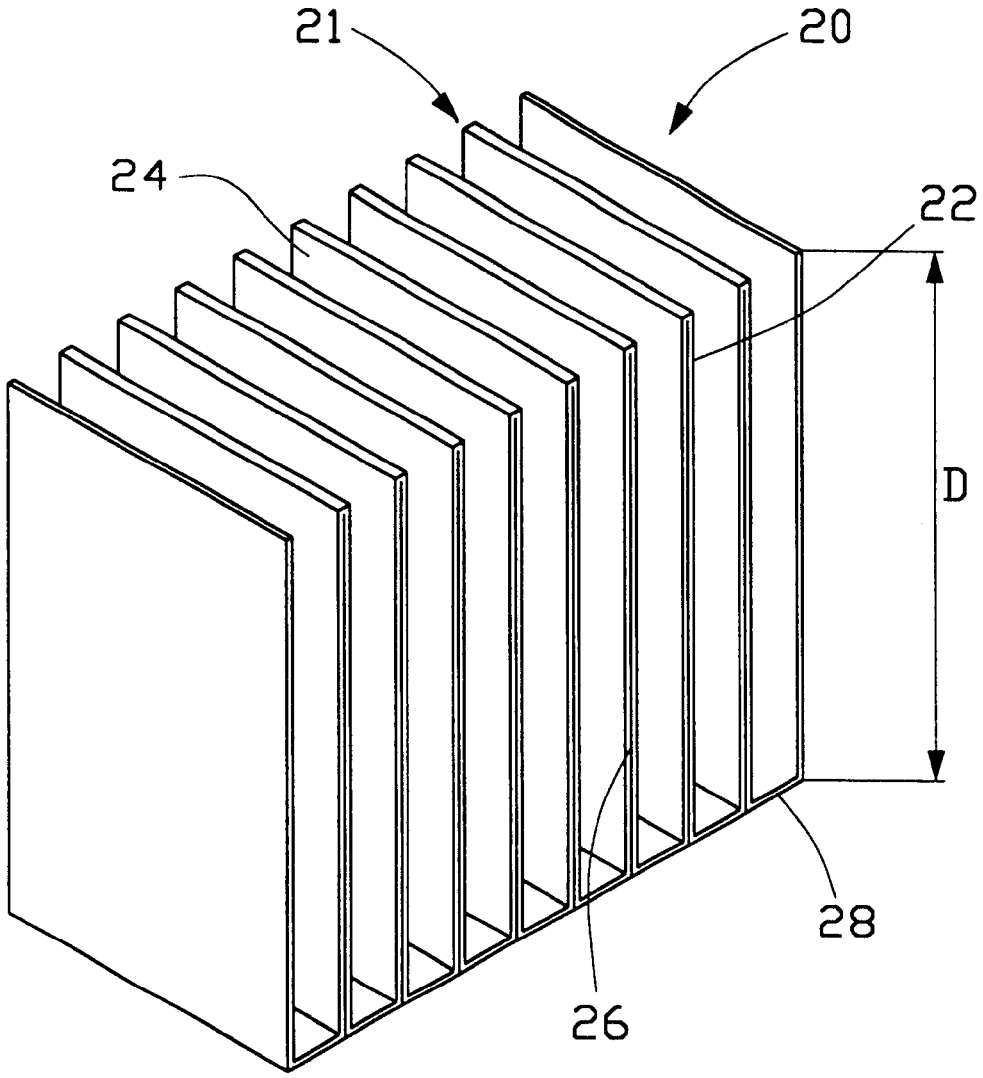
FIG. 1 is a perspective view of a heat dissipating member for a heat sink in accordance with the present invention.

Reference will now be made to the drawing figures to describe the present invention in detail.

Figure 2:
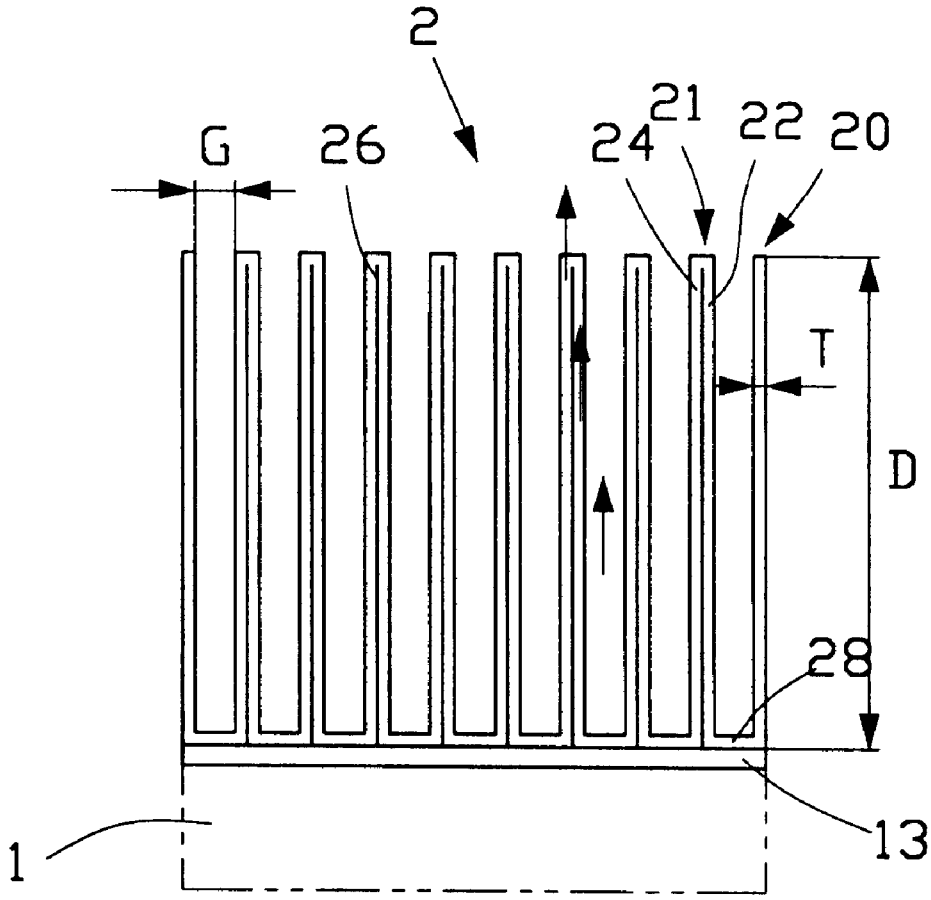
FIG. 2 is a side view of a heat sink formed by attaching the heat dissipating member of FIG. 1 to a base plate.

Referring to FIGS. 1 and 2, a heat dissipating member 20 for a heat sink 2 in accordance with the present invention comprises a plurality of folded fins 21 interconnected by planar portions 28. A distance G is defined between each pair of adjacent folded fins 21. Each folded fin 21 includes a first and a second vertical sections 22 and 24 made from a single metal sheet bent double with a slit 26 defined therebetween. Each vertical section 22, 24 has a thickness T.

The slits 26 are so narrow that the planar portions 28 substantially form a continuous plane. When the heat dissipating member 20 is attached to a base plate 13 to form the heat sink 2, a substantially maximum contact area is ensured between the heat dissipating member 20 and the base plate 13. Thus, the heat generated by the heat generating component 1 shown in phantom is efficiently transmitted from the base plate 13 to the heat dissipating member 20. The heat is effectively dissipated into the surrounding environment via three paths as indicated by the arrows, and no heat is accumulated between the first and the second vertical sections 22 and 24 of the fin 21. Therefore, the heat sink 2 has enhanced heat dissipating capabilities compared to the conventional designs thereby eliminating the requirement for an additional fan. Further, the height D of each folded fin 21 can be and length desired and will not break during manufacturing because the folded fins 21 will not be stretched during the forming process, as will be detailed hereinafter.

Figure 3:
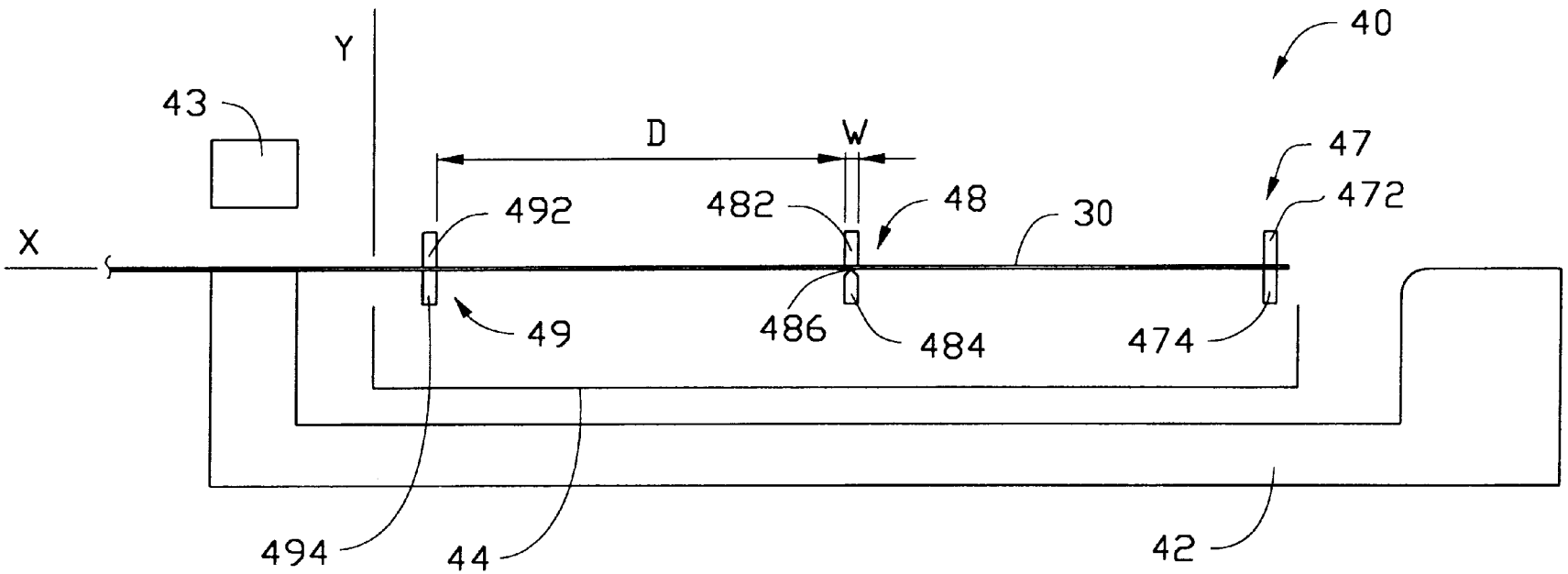
FIGS. 3 through 11 sequentially illustrate the steps of making the heat dissipating member of FIG. 1 by bending a metal plate with a machine of the present invention.

Referring to FIG. 3, a bending machine 40 for making the heat dissipating member 20 of the present invention comprises a machine tool 42, a fixed jig 43 for pressing against a metal plate 30, a carriage 44 for horizontally reciprocating along the machine tool 42, and a first, second and third forming jigs 47, 48 and 49 actuatably mounted on the carriage 44. The first forming jig 47 is distant from the fixed jig 43, the third forming jig 49 is adjacent to the fixed jig 43, and the second forming jig 48 is located between the first and the second forming jigs 47 and 49. Each forming jig 47, 48 and 49 includes an upper jig portion 472, 482 and 492 and a lower jig portion 474, 484 and 494, respectively. The upper jig portions 472, 482 and 492 and the lower jig portions 474 and 494 are rectangular in shape, while the lower jig portion 484 of the second forming jig 48 has a tapered end 486.

During the process of making the heat dissipating member 20, a predetermined length of the metal plate 30, preferably an aluminum plate, is first fed into the machine 40 and clamped by the forming jigs 47, 48 and 49. The fixed jig 43 is in a released position and the forming jigs 47, 48 and 49 are in an initial position with a distance D defined between each pair of adjacent forming jigs 47, 48 and 49.

Figure 4:
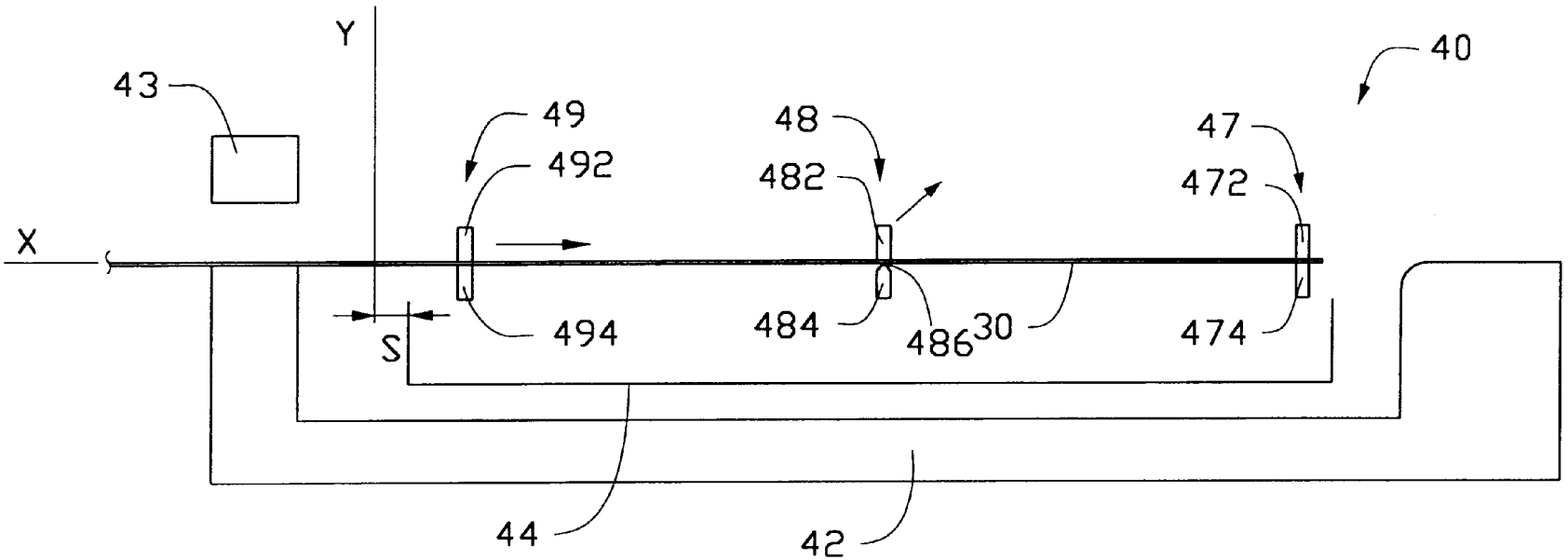

Referring to FIG. 4, the carriage 44 together with the forming jigs 47, 48 and 49 is then actuated to move a distance S away from the fixed jig 43. In this embodiment, the distance S is two times the width W of each forming jig 47, 48 and 49, and is equal to the distance G between each pair of adjacent formed fins 21. Therefore, the distance G between each pair of adjacent fins 21 of the heat dissipating member 20 formed by the process is equal to the distance S or is two times the width W. The second forming jig 48 then upwardly moves toward the first forming jig 47 at a specified angle, and the third forming jig 49 horizontally moves toward the first forming jig 47 to bend the metal plate 30.

Figure 5:
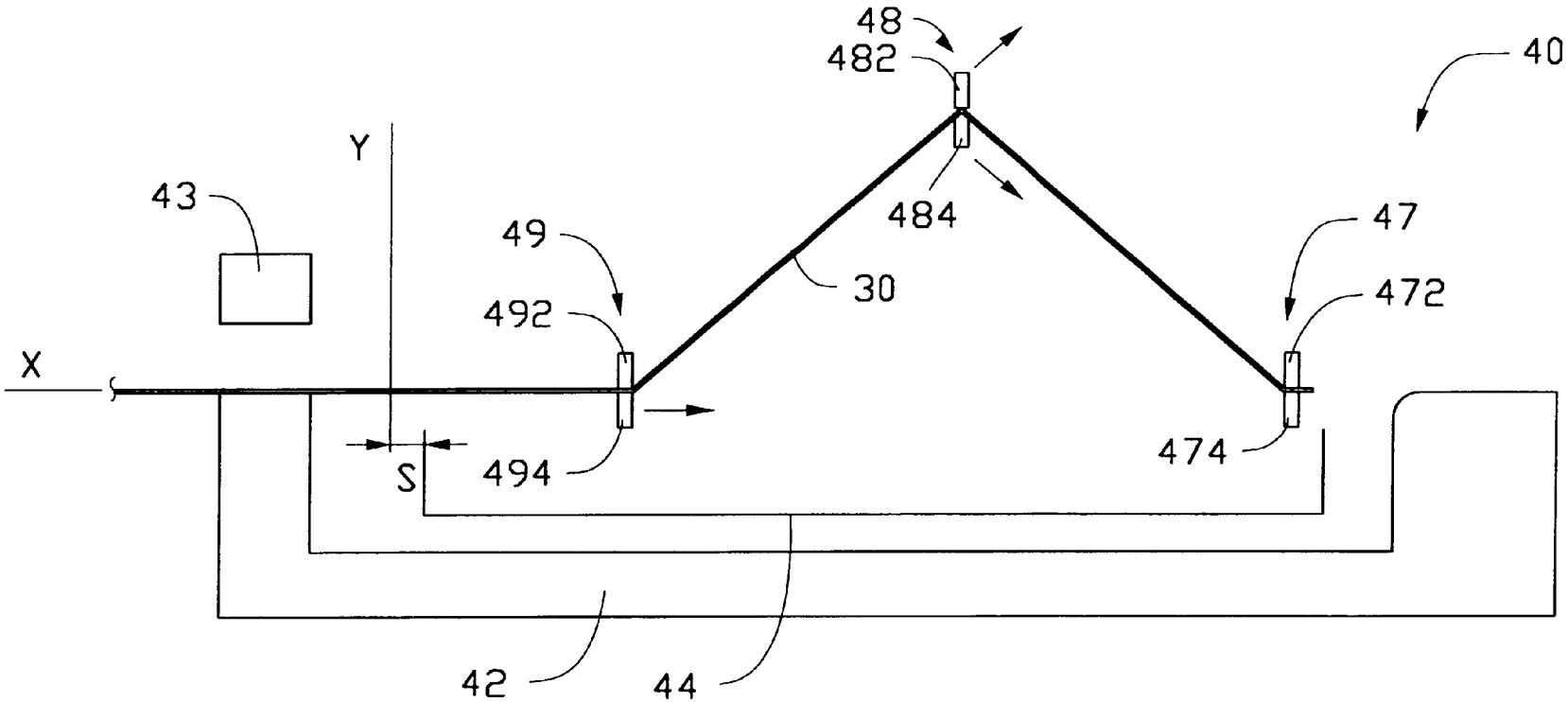
Figure 6:
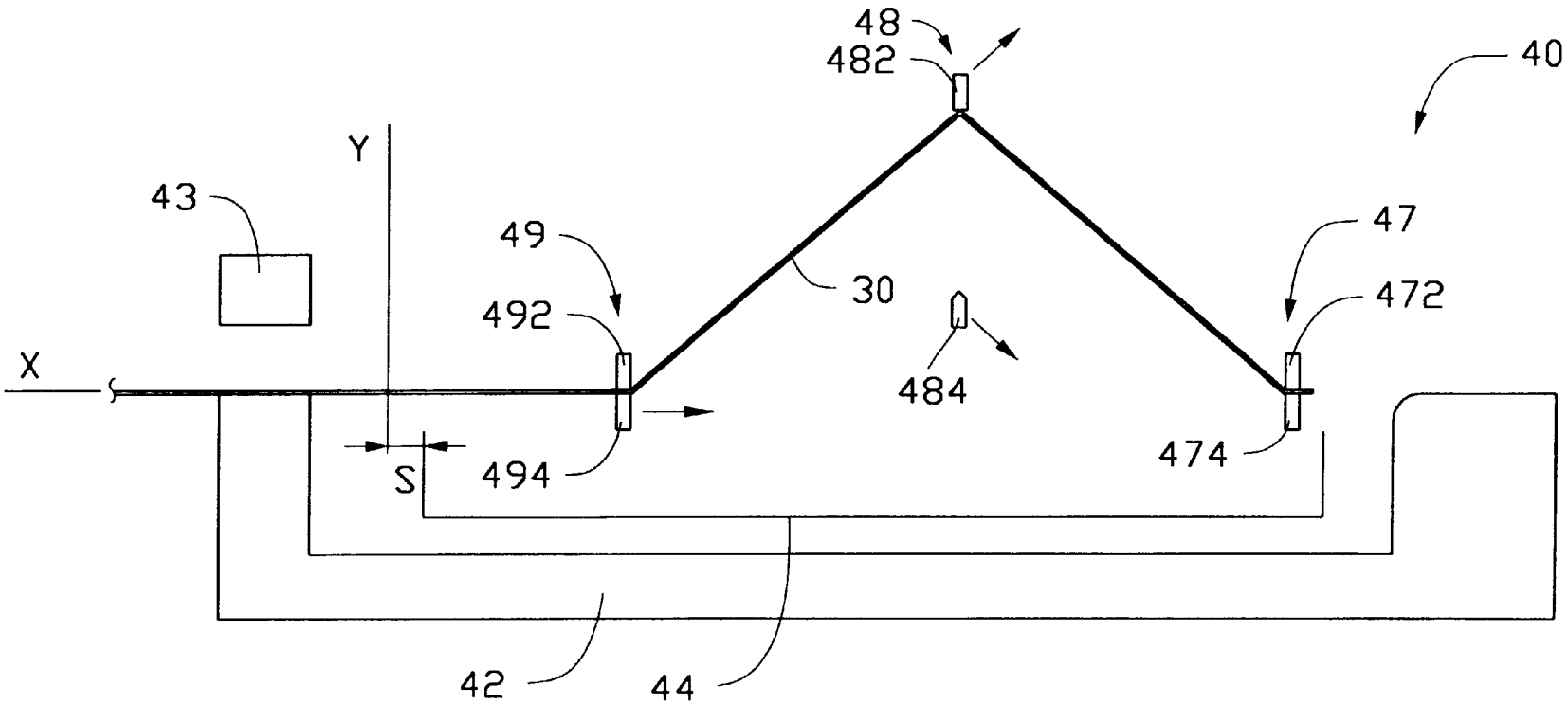

Referring to FIGS. 5 and 6, when the second and the third forming jigs 48 and 49 move to a second position where a portion of the metal plate 30 between the first and the third forming jigs 47 and 49 has been bent into a pair of symmetrically inclined sections, the lower jig portion 484 of the second forming jig 48 downwardly moves away from the metal plate 30 and toward the first forming jig 47 at a specified angle. The upper and lower jig portions 492 and 494 of the third forming jig 49 and the upper jig portion 482 of the second forming jig 48 continue to move toward the first forming jig 47 in the same directions as indicated in FIG. 4.

Figure 7:
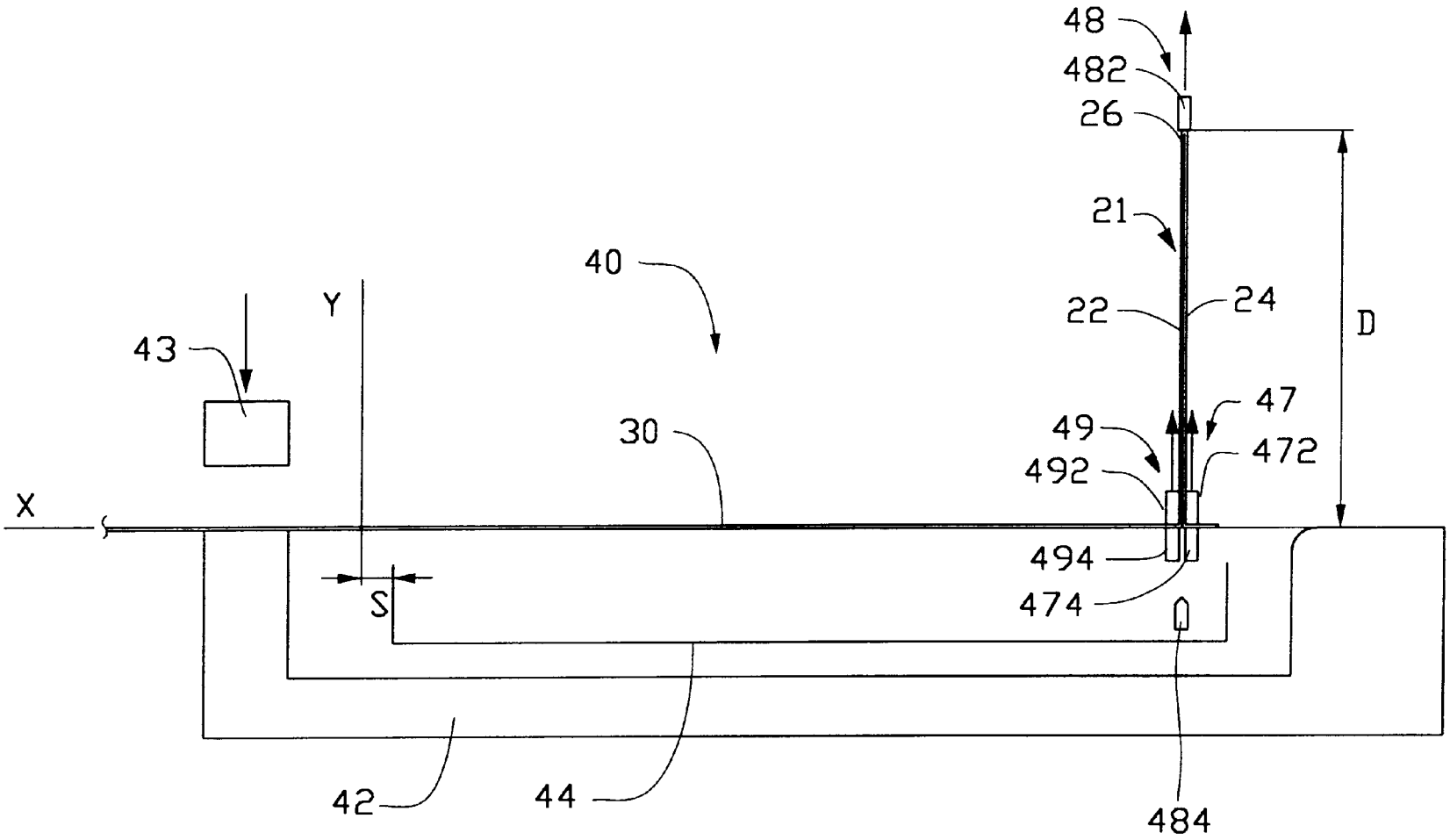

As shown in FIG. 7, a first folded fin 21 including a first and a second vertical sections 22 and 24 is formed when the second and the third forming jigs 48 and 49 have reached to a final position where the second forming jig 48 is spaced from the first forming jig 47 a distance equal to ½W+T and where the third forming jig 49 is spaced from the first forming jig 47 a distance equal to W+2T. In this position, both of the second and the third forming jigs 48 and 49 are located to the left of the first forming jig 47. The first folded fin 21 has a height equal to the distance D between each pair of adjacent forming jigs 47, 48 and 49 and a width substantially two times the thickness T of the metal plate 30, as shown in FIG. 3. During the aforesaid process of moving the second and the third forming jigs 48 and 49 toward the first forming jig 47 to form the fin 21, no stretching force is exerted on the metal plate 30 thereby maintaining the thickness T thereof and preventing breakage thereof. Therefore, the height D of the folded fin 21 can be as large as desired within the limitation of the size of the machine. In this embodiment, the preferred height D of the folded fin 21 is 60–100 times the thickness T of the metal plate 30.

Figure 8:
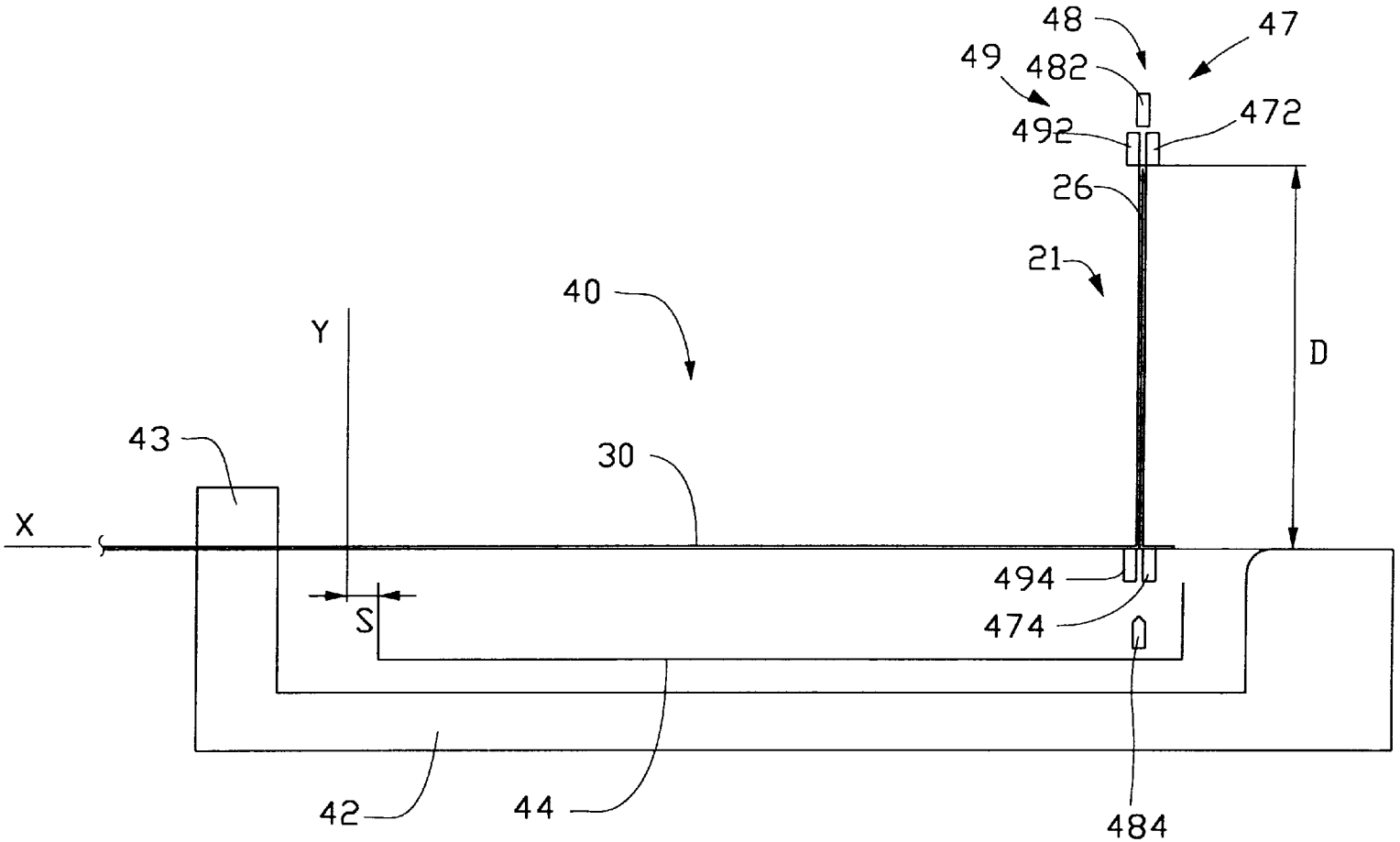

After the first folded fin 21 is formed, the fixed jig 43 is actuated to move downward to press the metal plate 30 against the machine tool 42. The respective upper jig portions 472, 482 and 492 of the first, second and third forming jigs 47, 48 and 49 upwardly move above the first fin 21. The upper jig portions 472 and 492 are at the same height and the upper jig portion 482 is above the upper jig portions 472 and 492, as shown in FIG. 8.

Figure 9:
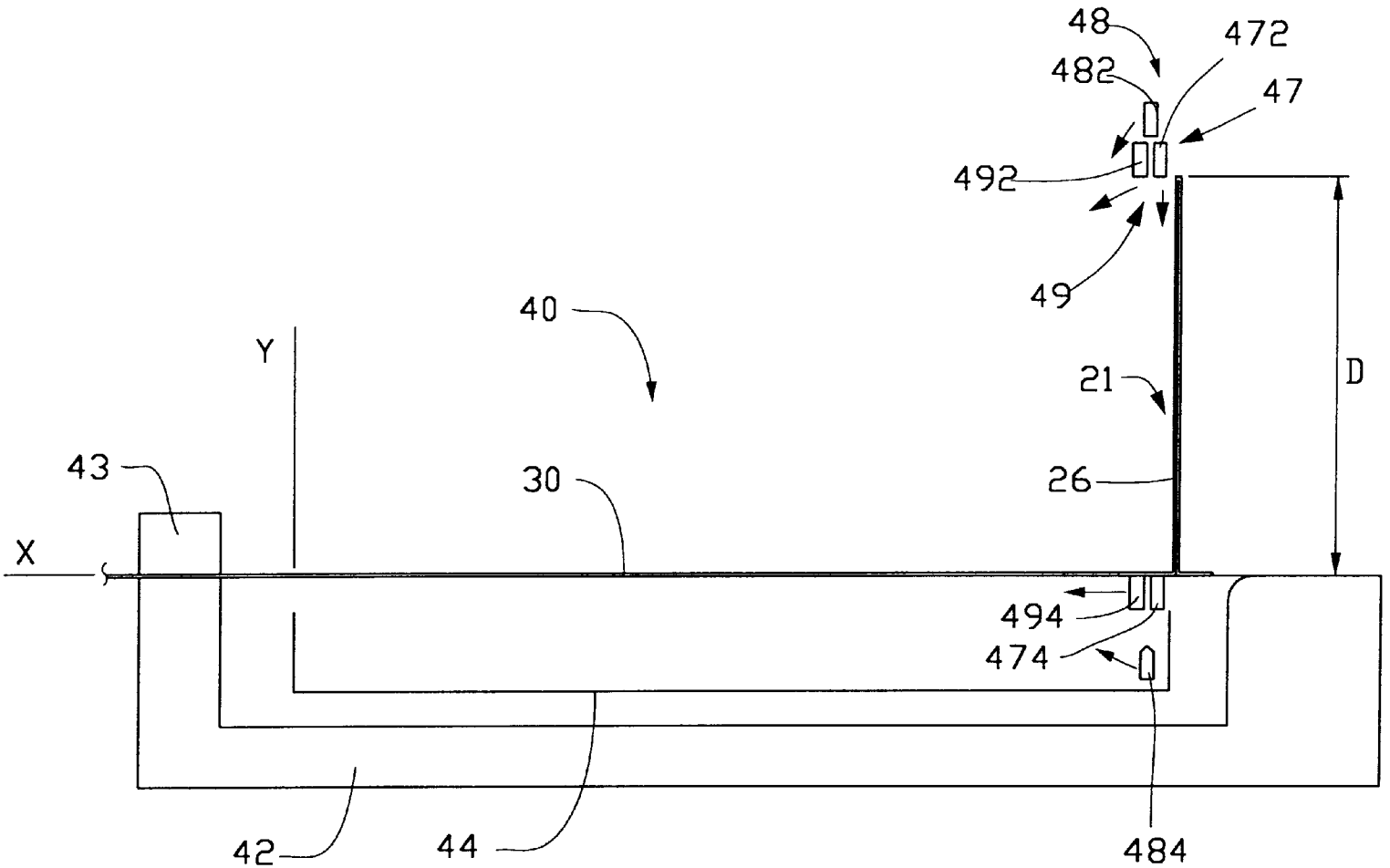
Figure 10:
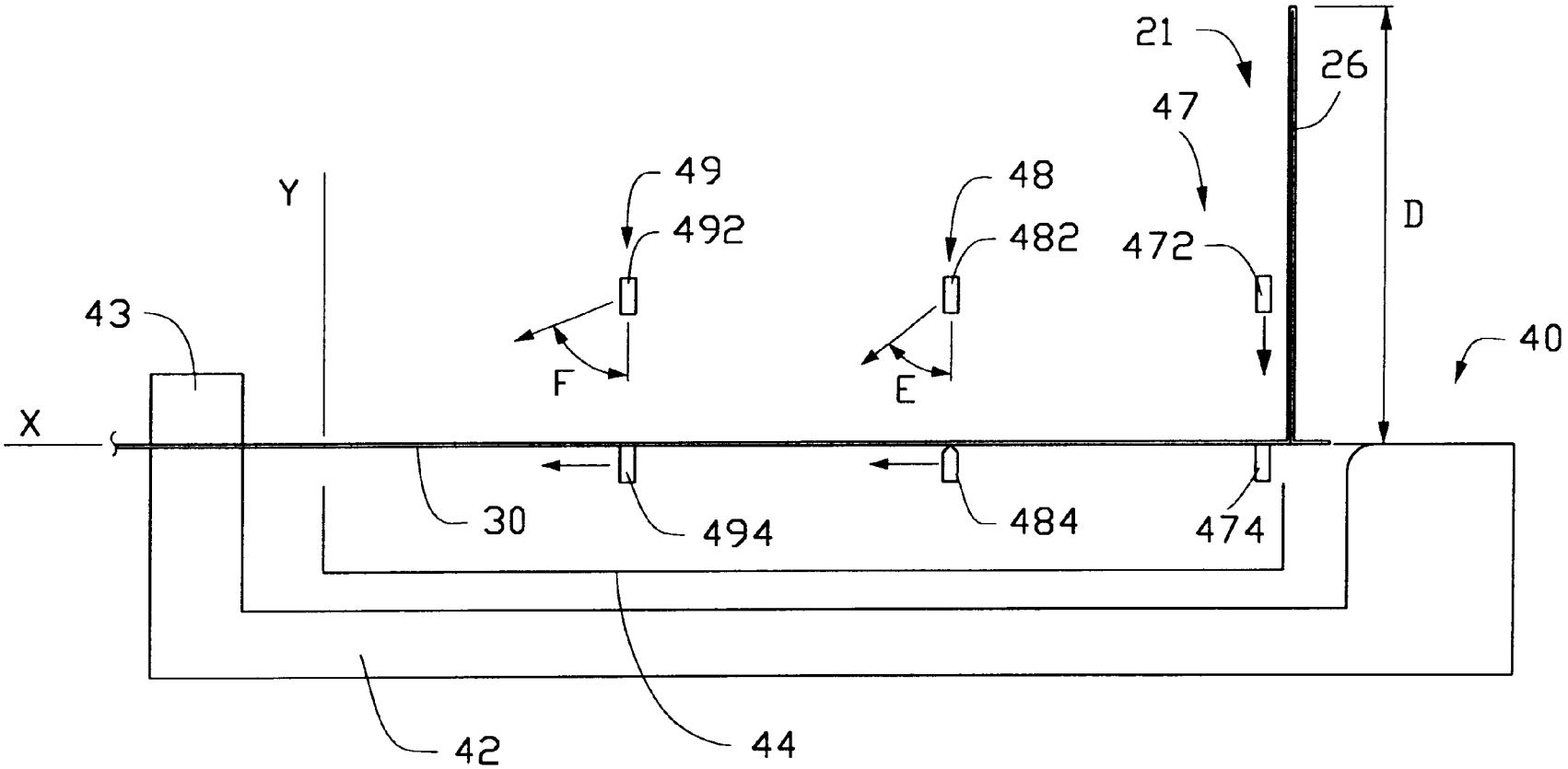
Figure 11:
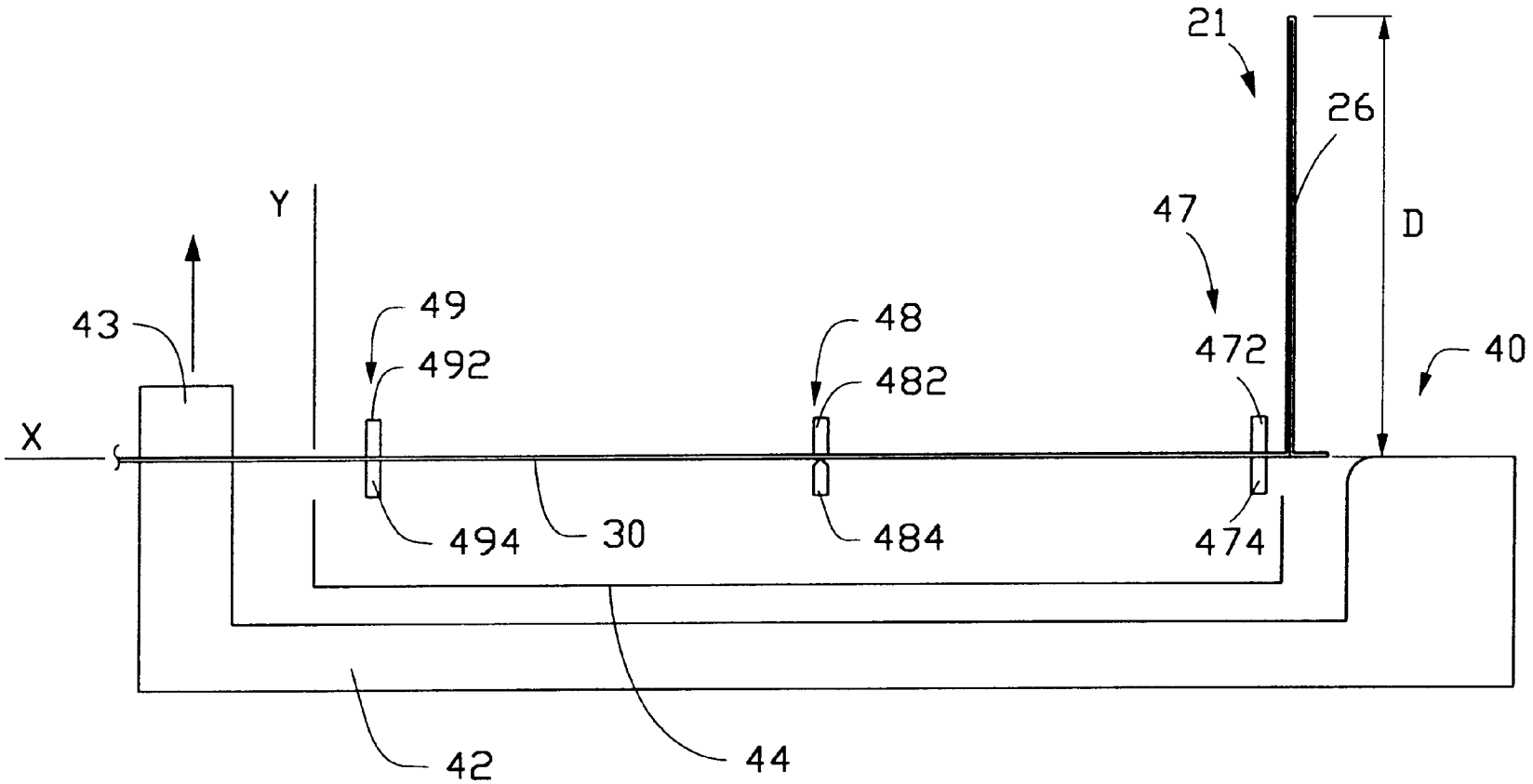
Figure 12:
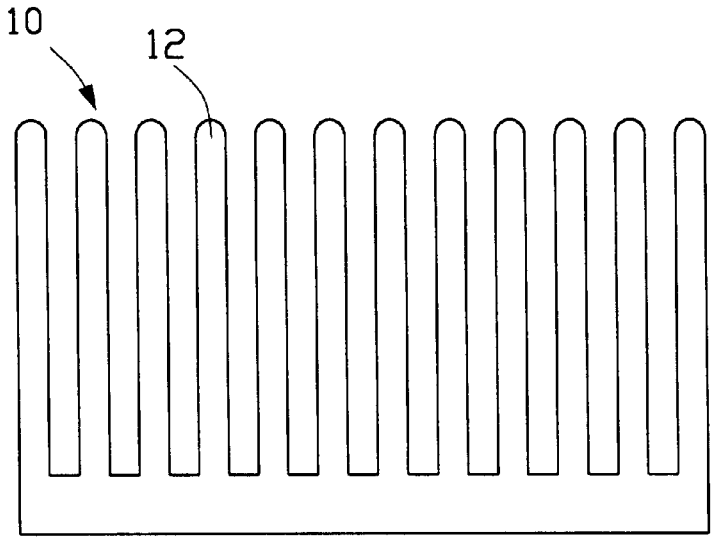
FIG. 12 (PRIOR ART)
FIG. 12 is a side view of a conventional heat sink integrally formed by extruding.
Figure 13:
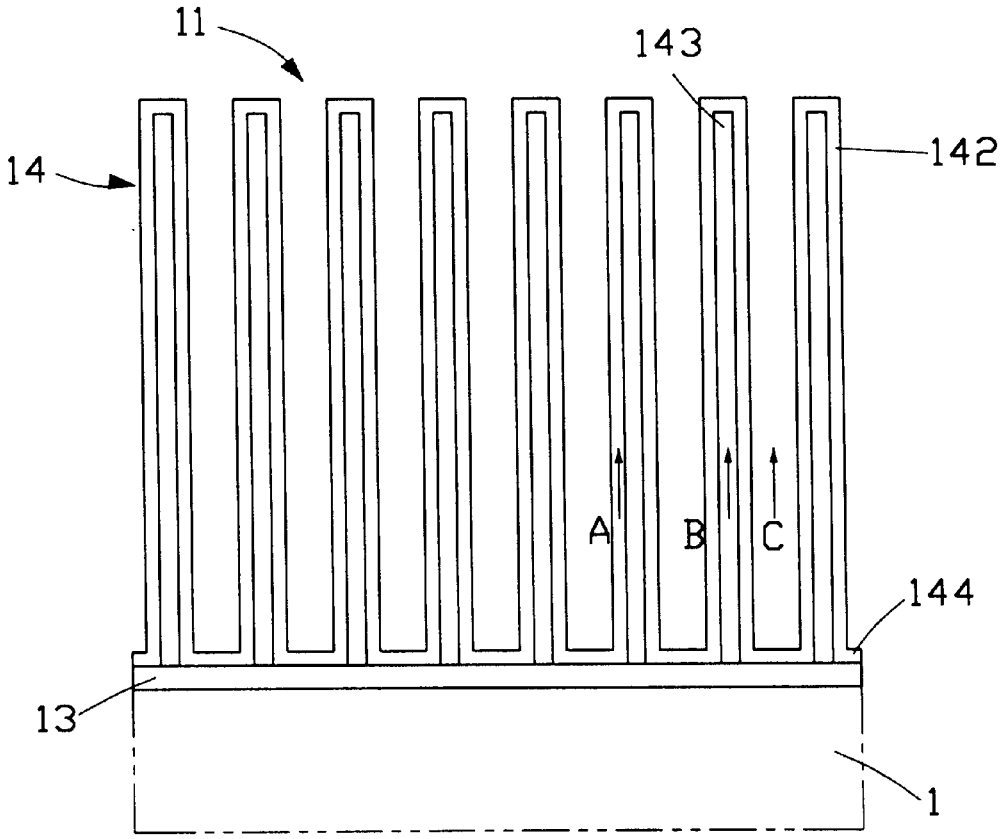
FIG. 13 (PRIOR ART)
FIG. 13 is a side view of another conventional heat sink formed by attaching a conventional heat dissipating member formed by stamping a metal plate or extruding from aluminum materials to a base plate.

Referring to FIGS. 9–11, the carriage 42 together with the forming jigs 47, 48 and 49 is actuated to move a distance S toward the fixed jig 43. The upper jig portion 472 of the first forming jig 47 downwardly moves toward the lower jig portion 474 to cooperatively clamp the metal plate 30. The lower jig portion 484 of the second forming jig 48 upwardly moves toward the metal plate 30 at a specified angle and then horizontally moves along the metal plate 30 toward the fixed jig 43 to return to the initial position. The upper jig portion 482 downwardly moves toward the lower jig portion 484 in an angle E to cooperatively clamp the metal plate 30. The lower jig portion 494 of the third forming jig 49 horizontally moves along the metal plate 30 toward the fixed jig 43 to return to the initial position. The upper jig portion 492 downwardly moves toward the lower jig portion 494 in an angle F which is larger than the angle E of the upper jig portion 482 to cooperatively clamp the metal plate 30. The fixed jig 43 is then actuated to move upward to release the metal plate 30, and the process as shown in FIGS. 3–8 is repeated to make a second folded fin 21. Thus, a heat dissipating member 20 having a plurality of folded fins 21 and planar portions 28 interconnecting the adjacent folded fins 21 as shown in FIG. 1 is made from the metal plate 30.

Since only a small contact area exists between each forming jig 47, 48 and 49 and the metal plate 30, a large amount of disengaging force will not be exerted on the folded fin 21 when the forming jigs 47, 48 and 49 disengage from the fin 21. The careful handling of the metal plate 30 by the bending machine 40 allows the formation of the heat dissipating member 20 having a significant height D. Each folded fin 21 has smooth surfaces without scrapes, and the results are better than those achieved by using a stamping process.

It can be noted that in this embodiment the lower jig portion 484 of the second forming jig 48 defines a tapered end 486 which is different the flat end disclosed in the copending application Ser. No. 09/218,725 filed Dec. 22, 1998. Because of this tapered end 486 which may somewhat cooperatively change the mechanical characteristics around the tip portion of each folded fin 21 during upwardly moving of the second forming jig 48, each folded fin 21 including the first and second vertical sections 22 and 24 can be tightly compressibly folded during the folding process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A method for making a folded fin of a heat sink, comprising the steps of:

a) preparing a metal plate;

b) clamping the metal plate by a first, a second and a third forming jigs in an initial position, the second forming jig being located between the first and the third forming jigs and being equidistant from the first and the third forming jigs, each forming jig including upper and lower jig portions, the lower jig portion of the second forming jig having a tapered end;

c) actuating the second forming jig to move upwardly and horizontally toward the first forming jig and the third forming jig to move horizontally toward the first forming jig to a second position where a portion of the metal plate between the first and the third forming jigs has been bent into a pair of symmetrically inclined sections; and d) actuating the lower jig portion of the second forming jig to move downwardly away from the metal plate while the pair of sections are inclined, and to move the third forming jig and the upper jig portion of the second forming jig toward the first forming jig to a final position where the pair of symmetrically inclined sections of the metal plate between the forming jigs has been bent double thereby forming a folded fin.

2. The method as described in claim 1, wherein the step b) comprises spacing each pair of adjacent forming jigs a distance 60–100 times the thickness of the metal plate.

3. A machine for making a folded fin of a heat sink having a height D, comprising:

sequentially and actuatably mounting first, second and third forming jigs each including upper and lower jig portions, the lower jig portion of the second forming jig having a tapered end, the forming jigs clamping a metal plate fed into the machine in an initial position where each pair of adjacent forming jigs is spaced a distance D, the second forming jig then being actuated to move upwardly and horizontally toward the first forming jig and the third forming jig being actuated to move horizontally toward the first forming jig to a second position where a portion of the metal plate between the first and the third forming jigs has been bent into a pair of symmetrically inclined sections, the lower jig portion of the second forming jig then being actuated to move downwardly away from the metal plate while the pair of sections are inclined, and the third forming jig and the upper jig portion of the second forming jig being actuated to move toward the first forming jig to a final position where the pair of symmetrically inclined sections of the metal plate between the forming jigs has been bent double thereby forming a folded fin.

4. The machine as described in claim 3, further comprising a carriage on which the forming jigs are sequentially and actuatably mounted.

5. The machine as described in claim 4, further comprising a fixed machine tool along which the carriage horizontally reciprocates.

6. The machine as described in claim 5, further comprising a fixed jig actuatably mounted on the fixed machine tool.

7. The machine as described in claim 3, wherein the distance D between each pair of adjacent forming jigs is 60–100 times the thickness T of the metal plate.

8. A method for using a machine for making a heat dissipating member of a heat sink having a plurality of folded fins, the machine comprising a fixed machine tool, a fixed jig actuatably mounted on the fixed machine tool, a carriage for horizontally reciprocating along the machine tool, and a first, a second and a third forming jigs sequentially and actuatably mounted on the carriage, each forming jig having a width W and including upper and lower jig portions, the lower jig portion of the second forming jig having a tapered end, the method comprising:

a) feeding a metal plate into the fixed machine tool;

b) clamping the metal plate by the first, the second and the third forming jigs in an initial position where each pair of adjacent forming jigs is spaced a distance D;

c) actuating the carriage together with the forming jigs and the metal plate to move a distance S away from the fixed jig;

d) actuating the second forming jig to move upwardly and horizontally toward the first forming jig and the third forming jig to move horizontally toward the first forming jig to a second position where a portion of the metal plate between the first and the third forming jigs has been bent into a pair of symmetrically inclined sections;

e) actuating the lower jig portion of the second forming jig to move downwardly away from the metal plate while the pair of sections are inclined, and to move the third forming jig and the upper jig portion of the second forming jig toward the first forming jig to a final position where the pair of symmetrically inclined sections of the metal plate between the forming jigs has been bent double thereby forming a folded fin;

f) actuating the fixed jig to move downwardly to press the metal plate against the machine tool;

g) actuating the upper jig portions of the forming jigs to move upwardly away from the folded fin;

h) actuating the carriage together with the forming jigs to move the distance S toward the fixed jig;

i) actuating the forming jigs to return to the initial position to clamp the metal plate;

j) releasing the fixed jig from the metal plate; and k) repeating steps c) to j) to form another folded fin.

9. The method as described in claim 8, wherein the distance S of the step c) is two times the width W of each forming jig.

10. The method as described in claim 8, wherein the step g) comprises moving the upper jig portions of the first and the third forming jigs upwardly away from the folded fin to the same height below the upper jig portion of the second forming jig of the step g).

11. The method as described in claim 8, wherein the step i) comprises moving the upper jig portion of the second forming jig downwardly away from the folded fin in an angle E to return to the initial position, and moving the lower jig portion of the second forming jig upwardly and horizontally toward the fixed jig to return to the initial position.

12. The method as described in claim 11, wherein the step i) comprises moving the upper jig portion of the third forming jig downwardly away from the folded fin in an angle F to return to the initial position, and moving the lower jig portion of the third forming jig horizontally toward the fixed jig to return to the initial position.

13. The method as described in claim 12, wherein the angle F is larger than the angle E.

14. A method of making a heat sink with a plurality of juxtaposed fully compressed fins thereof, comprising the steps of:

preparing a metal plate;

clamping the metal plate by first, second and third forming jigs spaced from one another with equal distances under a condition that said second forming jig is positioned between said first and third forming jigs, each of said first, second and third forming jigs includes upper and lower jig portions sandwiching the metal plate therebetween, the lower jig portion of the second forming jig defining a tapered end directing to the corresponding upper jig portion;

actuating the second forming jig to move upwardly away from a plane said metal plate originally seated on, and having the first and third forming jigs closer to each other along said plane until a portion of the metal plate by two sides of said second forming jig has been bent to a pair of inclined sections with a peak configuration converged at the second forming jig; and actuating the lower jig portion of the second forming jig to move downward away from the metal plate while the pair of sections are inclined, and further having the first and third forming jigs move closer to each other along said plane until said pair of inclined sections substantially tightly abut against each other to form said completely compressed fin.

15. The method as described in claim 14, wherein a distance between every adjacent two fins is not less than a width of the first forming jig.

16. The method as described in claim 15, wherein the third forming jig has the same width with the first forming jig, and said distance is two time of said width.

* * * * *